US006009850A

United States Patent [19]

DeLuca

[11] Patent Number: 6,009,850

[45] Date of Patent: Jan. 4, 2000

[54] HIGH-PRESSURE DUAL-FEED-RATE INJECTOR PUMP WITH GROOVED PORT-CLOSING EDGE

[75] Inventor: Frank DeLuca, Enfield, Conn.

[73] Assignee: Alfred J. Buescher, Shaker Heights, Ohio

[21] Appl. No.: 09/058,341

[22] Filed: Apr. 10, 1998

[51] Int. Cl.[7] ..... F02B 3/00; F02B 7/04

[52] U.S. Cl. ..... 123/299; 417/494

[58] Field of Search ..... 123/299, 300, 123/500, 501, 446; 417/494, 492, 493; 239/88

[56] References Cited

U.S. PATENT DOCUMENTS

| | | | |
|---|---|---|---|
| 1,981,913 | 11/1934 | Fielden . | |
| 2,513,883 | 7/1950 | Male . | |
| 2,547,174 | 4/1951 | Rogers . | |
| 2,551,053 | 5/1951 | Rogers . | |
| 2,890,657 | 6/1959 | May et al. . | |
| 3,006,556 | 10/1961 | Shade et al. . | |
| 3,115,304 | 12/1963 | Humphries . | |
| 3,216,359 | 11/1965 | Teichert . | |
| 3,267,863 | 8/1966 | Clifton . | |
| 3,481,542 | 12/1969 | Huber . | |
| 3,566,849 | 3/1971 | Frick . | |
| 3,567,346 | 3/1971 | Mekkes et al. . | |
| 3,827,832 | 8/1974 | Faupel et al. . | |
| 3,837,324 | 9/1974 | Links . | |
| 3,880,131 | 4/1975 | Twaddell et al. . | |
| 3,942,914 | 3/1976 | Hofer et al. . | |
| 4,073,275 | 2/1978 | Hofer et al. . | |
| 4,129,253 | 12/1978 | Bader, Jr. et al. . | |
| 4,165,723 | 8/1979 | Straubel . | |
| 4,229,148 | 10/1980 | Richmond | 417/485 |
| 4,351,283 | 9/1982 | Ament . | |
| 4,389,987 | 6/1983 | Frankle | 123/300 |
| 4,392,612 | 7/1983 | Deckard et al. . | |
| 4,470,545 | 9/1984 | Deckard et al. . | |
| 4,527,737 | 7/1985 | Deckard . | |
| 4,572,433 | 2/1986 | Deckard . | |
| 4,709,679 | 12/1987 | Djordjevic et al. . | |
| 4,741,314 | 5/1988 | Hofer . | |
| 4,757,794 | 7/1988 | Hofer . | |
| 4,870,936 | 10/1989 | Eheim | 123/449 |
| 4,881,506 | 11/1989 | Hoecker . | |
| 4,940,037 | 7/1990 | Eckert | 123/506 |
| 4,951,874 | 8/1990 | Ohnishi et al. . | |
| 4,975,029 | 12/1990 | Hatz | 123/299 |
| 5,029,568 | 7/1991 | Perr . | |
| 5,209,208 | 5/1993 | Siebert et al. | 123/299 |
| 5,233,955 | 8/1993 | Kraemer et al. | 123/299 |
| 5,286,178 | 2/1994 | Schaef | 123/299 |
| 5,390,851 | 2/1995 | Long et al. . | |

FOREIGN PATENT DOCUMENTS

| | | |
|---|---|---|
| 0045654 | 2/1990 | Japan . |
| 1375848 | 2/1988 | U.S.S.R. . |

*Primary Examiner*—Thomas N. Moulis
*Attorney, Agent, or Firm*—Pearne, Gordon, McCoy & Granger LLP

[57] ABSTRACT

A groove having a helix angle of zero or more is formed in the plunger of a diesel injector pump, the groove extending along and in association with the port-closing edge of the plunger and along at least a portion of the length of such port-closing edge. The groove interacts with the port that is associated with the port-closing edge to provide, in each of a succession of plunger strokes, initial fuel injection at feed rates lower than those which would obtain in the absence of the groove but without any loss of initial injection pressure, or without substantial loss of such pressure.

23 Claims, 13 Drawing Sheets

10
11
32
19
18
29
28
2
16
22
24
26
25
14
15
27
21
23
2
22
21
14
27
24
26
23
15
3X
22a
21a
14a
15a
27a
24a
26a
25a
23a
34a
3X
22c
21c
14c
15c
27c
24c
23c
34c
3Y
3Y
22a
21a
14a
21a
14a 15a
27a
23a
21a
34a
36a 15b
27b
3B
23b
21b
34b
36b
3B 15c
4A
27c
23c
21c
34c'
34c
4A 15d
27d
23d
21d
34d'
34d 15e
23e
34e'
34e 15c
34c'
34c
23c (ZERO)

(PILOT)

(IDLE)

(HALF LOAD)

(FULL LOAD)

(ZERO)

FIG. 11 (PILOT)

FIG. 12 (IDLE)

FIG. 13 (HALF LOAD)

(FULL LOAD)

HIGH-PRESSURE DUAL-FEED-RATE INJECTOR PUMP WITH GROOVED PORT-CLOSING EDGE

FIELD OF THE INVENTION

This invention relates to diesel fuel injectors and fuel injection pumps of the mechanical spill type (in which spill valving is controlled by mechanical linkages driven by the engine), as distinguished from the solenoid spill type (in which spill valving is controlled by solenoid actuators). The invention is applicable to systems in which one fuel metering element or pump is used for each cylinder of the engine. Thus the invention is applicable to unit injectors used on locomotive and automotive engines, in which the pump, nozzle and holder assembly are a single unit. The invention is also applicable to injection systems in which the fuel is fed from the pump through tubing to a separate nozzle and holder assembly uniquely associated with that pump.

BACKGROUND OF THE INVENTION

Reference is made to my co-pending application entitled HIGH-PRESSURE DUAL-FEED-RATE INJECTOR PUMP WITH AUXILIARY SPILL PORT, filed on the same day as the present application and directed to related subject matter. The disclosure of such co-pending application is incorporated by reference in this application as if fully repeated herein.

Some fuel injector pumps of the mechanical spill type rely on a sleeve separate from the bushing and slidable on or relative to the pump plunger to contribute to the valving of fuel, in order for example to combine spill valving with the sequential distribution of fuel from a single pump to two or more injection nozzles at two or more separate cylinders of a diesel engine. In such "sleeved" assemblies, there is one pattern of relative motion between the pump plunger and the bushing and an altered pattern of relative motion between the plunger and the sleeve.

However the type of plunger and bushing pumps to which the invention relates are of a another sub-type which may be referred to as "sleeveless" in that no sleeves are used for spill valving; rather the pump's own spill valving functions (as distinguished from the valving functions of a check valve or an injection valve associated with the pump) are entirely accomplished by interactions between (1) edges and cut-outs formed on the pump plunger and (2) orifices opening into the pump bore from the low pressure passages. Such sleeveless pumps or plunger and bushing devices are typically associated with the use of one pump for each cylinder of the engine.

Fuel injectors of the sleeveless mechanical spill type include a fuel pump and an injection nozzle associated with the fuel pump. The fuel pump includes a pump cylinder or "bushing" and a pump plunger reciprocable in the bushing. Such a "plunger and bushing" ("p&b") assembly defines a pump chamber open at one end for the discharge of fuel during a pump stroke and for fuel intake during a suction or fill stroke of the plunger. The injection nozzle is associated with a valve body having a spray outlet at one end for the discharge of fuel at the nozzle tip. The injection valve is movable in the valve body between open and closed positions to control flow from the spray outlet. The injection valve is spring-biased to a closed position and openable when such discharge of fuel during a pump stroke reaches a given high pressure. The injection valve then remains open until pressure drops to a closing pressure somewhat below the opening pressure. The closing pressure is below the opening pressure because the injection valve face area subject to injection pressures is somewhat greater when the injection valve is open and unseated than when it is closed and seated.

Fuel is supplied to the pump and excess fuel is returned from the pump to a reservoir through low pressure passages communicating with the pump chamber. The low pressure passages constitute spill passages for spilling the fuel discharged by the pump stroke of the plunger. The spill passages intersect the bushing bore at spill ports. The flow areas of the spill ports are each large enough that the fuel is spilled back into the low pressure supply system at a rate high enough to prevent the discharge of fuel, resulting from the pump stroke, from reaching the given pressure at which the injection valve opens to commence fuel injection, or from remaining above the somewhat lower given pressure at which the open injection valve closes.

The length of the injection portion of the pump stroke is adjustable by suitable means including a port-closing edge and a port-opening edge each associated with its own one of a pair of ports opening into the plunger-receiving bore of the bushing. The port-closing and port-opening edges may also be referred to as land edges or as control edges. The port-closing and port-opening edges have different helix angles whereby the interval between port closing (of one port of the pair) and port opening (of the other port in the pair) in each pumping stroke is increased as the angular position of the plunger and the two edges around the axis of the plunger is adjusted throughout a range of adjustment to increase the injection portion of the pump stroke throughout a corresponding range of engine loads. One of these two edges may have a helix angle of zero.

Fuel injection, that is, delivery of fuel to the injection nozzle downstream of the plunger chamber at a high enough pressure to cause the injection valve to open and to remain open, occurs during that part of each stroke of the pump plunger during which both the ports associated with the pair of port control edges are closed or covered by their associated control edges to thereby establish, between the closing of one port and the opening of the other, the fuel delivery effective stroke, i.e., the injection portion of the pump stroke.

The initial rate of fuel injection has a profound influence on the maximum combustion pressure and temperature generated in diesel engine combustion chambers during engine operation. When combustion pressure and temperature are elevated above certain limits, nitrogen is oxidized to form nitrous oxide. Ignition delay is the principal reason for the high pressure and temperature generated. Improved ignition quality of fuel and higher compression pressures can reduce the ignition delay period, but there is a limit to the improvement that can be achieved with improved fuel quality, which also carries a cost penalty. Higher compression pressures also have the adverse effect of increasing maximum combustion pressure which in turn tends to increase the formation of nitrous oxide.

BRIEF DESCRIPTION OF THE INVENTION

The present invention contemplates controlling maximum combustion pressure and temperature in a more appropriate and cost effective way by delivering injected fuel at a lower rate during the early part of the injection portion of the pump stroke corresponding to the ignition delay period. Importantly, this is done in such a way that, although the feed rate is reduced, the initial injection pressure is maintained at a relatively high level, preferably at a level which is undiminished from that of a system having no provision for lowering the feed rate during the early part of the injection portion of the pump stroke. This accomplishment of "high-pressure" injection during low-feed-rate initial injection as well as during the final part of injection may be referred to as high-pressure dual-feed-rate injection.

According to the invention, a groove is formed in the plunger of the injector pump, the groove extending along and in association with the port-closing edge mentioned above and along at least a portion of the length of the port-closing edge. The groove interacts with the spill port that is associated with the port-closing edge (that is, the groove interacts with the "inlet port") to provide, in each of a succession of plunger strokes, initial fuel injection at average feed rates lower than those which would obtain in the absence of the groove. Such initial fuel injection at relatively low average feed rates can be referred to as pilot injection, and the remaining portion of fuel injection can be referred to as main injection. The shape and dimensions of the groove and its relation to its associated port-closing edge and other parts can be selected, and preferably is selected, to also provide initial injection pressures equal to or close to those which would obtain in the absence of the groove. The groove may be either an off-edge groove formed in the plunger adjacent to and spaced from the port-closing edge or an on-edge groove formed on the port-closing edge itself. Pilot injection may be separated from main injection by a few degrees or fractions of a degree of crank movement of the pump drive, or pilot injection may be unseparated from the main injection.

The invention utilizes the inherent ruggedness and simplicity of a sleeveless plunger and bushing construction to provide on a practical basis a precise mechanical valving control which accomplishes high-pressure dual-feed-rate injection. The comparative ruggedness and simplicity of the sleeveless valving mechanism makes it possible, with proper porting or spilling action (lacking in prior-art sleeveless devices), to achieve reduced initial feed rate without reducing initial injection pressure, or reducing it only slightly.

In sleeved devices, such is not practical because they are actuated by cams that have lifts that are approximately half, or less, of the lifts of cams that operate the sleeveless devices. The reduced total stroke puts severe limits on the ability of the sleeved devices to provide the normal pump functions such as (1) fill—the initial portion of the plunger stroke (during which both of the ports into the plunger bore are open) required to fill the pumping chamber at high speed, (2) effective stroke—that portion of the cam lift (plunger movement) required to deliver the full-load fuel quantity, and (3) the deceleration portion of the cam lift—that portion of the plunger stroke required to decelerate the reciprocating parts of the follower mechanism to zero at the top of the plunger stroke at high speed.

As just stated, the sleeved design has only about half or less of the plunger stroke (cam lift) of the sleeveless design, and is thereby limited in its ability to perform normal pump functions. Therefore, the sleeved design is unsuitable to the provision of any additional function that requires use of a significant portion of the cam lift, such as the provision of pilot injection characteristics as contemplated by the present invention. Furthermore, sleeved design pumps are used only in high-speed engines. They cannot be use in high-output medium-speed engines for the reasons mentioned above and also because extremely long connecting tubings would be required.

In the past, it has been attempted to deliver fuel at an initially reduced rate by using a two-stage lift cam whereby the initial portion of the cam lift is limited to produce a fixed quantity of fuel delivery by the plunger and then the cam lift ceases for a small period, or slows down, and then resumes its lift at the normal rapid rate to complete the plunger stroke. This two-stage lift method has not been successful because the initial wave generated at port closing is a function of engine speed and injection is inconsistent in the low and intermediate engine speed ranges.

Another previous method has used a separate small plunger to inject a small pilot quantity of fuel preceding the delivery by the main plunger of the main quantity of fuel required by the engine to develop the power required. This is a mechanically complicated and relatively costly system and has not been successful.

It has also been known in the prior art to provide auxiliary porting for a reduced rate of fuel feed in the early part of the injection portion of the plunger stroke, but such arrangements were intended to minimize initial injection pressure and are not believed to have been successful. An example of this is seen in U.S. Pat. No. 2,513,883 to J. F. Male.

It has also been known to use auxiliary porting arrangements effective at varying proportions of the injection portion of the feed stroke, as for example in U.S. Pat. No. 4,741,314 to Hofer in which auxiliary porting is arranged so there is a declining duration of leakage as the engine load increases in a straight line relationship with load such that maximum duration of leakage is at idle and there is zero duration of leakage at full load.

It is to be noted that the present invention does not employ auxiliary porting, since only two ports need be provided opening into the bushing bore, the feed rate variance in the present invention being accomplished by the interaction between the port-closing edge and the port and groove associated with the port-closing edge. The use of only two ports is not novel, and indeed is characteristic of several prior-art injectors, including (1) the injector illustrated as prior art in FIGS. 1 and 2 in the present case, (2) a certain newer EMD design (acronym for Electromotive Division, formerly a division of General Motors) that is known to the industry and is referred to below, (3) a certain GE design known to the industry, and also referred to below, and (4) a design shown in USSR author's certificate 1375848 to Yarosl. However, none of these devices provides a groove (whether on-edge or off-edge) associated with a port-closing edge and spill port to provide reduced feed rate pilot injection with little or no reduction in initial injection pressure over a range of load adjustments as taught by the present invention.

Yarosl does purport to increase "preliminary pressure" of injection in a p&b assembly. He uses a throttling orifice in the port associated with the port-closing edge (the port 2 associated with the edge 6). This throttling within the port applies even before the port 2 begins to be closed by the edge 6 and also applies during the return or fill stroke of the plunger, reducing filling efficiency of the pump. Yarosl does not employ a plunger groove associated with the port-closing edge as taught by the present invention.

BRIEF DESCRIPTION OF THE DRAWINGS

FIG. 3BX is a fragmentary sectional view, on an enlarged scale, taken from line 3BX—3BX in FIG. 3B and showing a sectional fragment of the bushing at the locus of the spill port (the "inlet port") that is associated with the port-closing edge.

FIG. 3BY is a fragmentary sectional view similar to FIG. 3BX but showing an off-edge groove modified from the off-edge groove of FIG. 3BX.

FIG. 4AX is a section taken from line 4AX—4AX in FIG. 4A.

FIG. 9A shows a pilot injection that is separated from main injection (as in the embodiment of FIGS. 3 and 3A). FIG. 9B shows a pilot injection that is not separated from main injection (as in the embodiments of FIGS. 4A, 4B, and 4C).

FIGS. 10–14 are development views or diagrams similar to FIGS. 5–9 but applicable to the embodiment of the invention illustrated in FIG. 4A.

FIGS. 11A–14A are hypothetical plots of rates of injection against plunger position similar to FIGS. 9A and 9B, but corresponding respectively to the operating modes of the injection pump seen in FIGS. 11–14.

FIGS. 16–19 are fragmentary diagrammatic views on the same scale showing the invention embodied in still another known type of p&b assembly which be referred to as a GE type plunger.

DETAILED DESCRIPTION OF THE INVENTION

Figures 1, 2, 3, 3X, 3Y, 4:
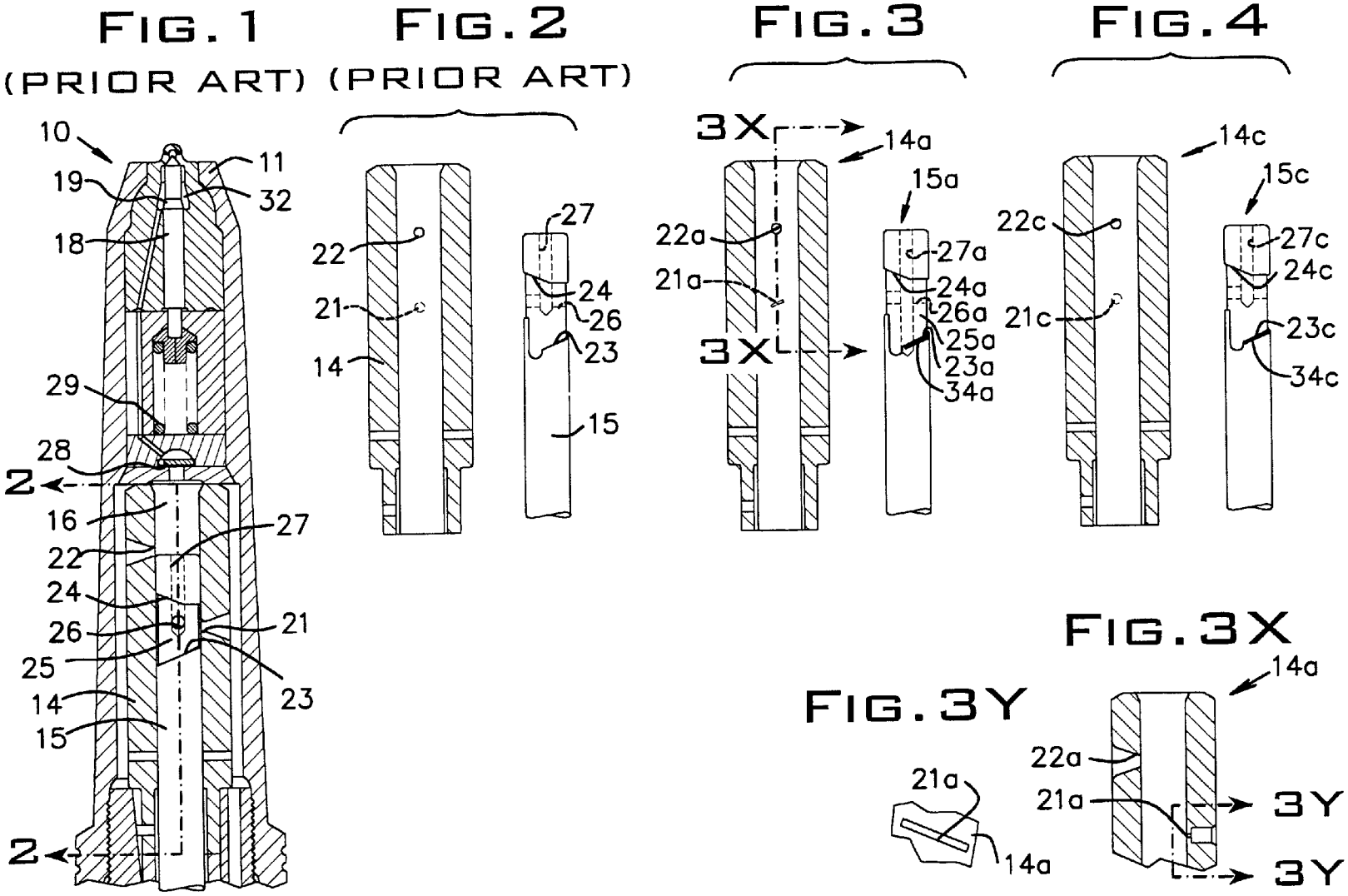
FIG. 1 (PRIOR ART)
FIG. 2 (PRIOR ART)
FIG. 1 is a fragmentary cross-section of a prior art unit injector illustrating one environment in which the invention may be employed; the pump plunger of the illustrated injector is shown at full retraction and at the adjusted angular position where there will be no injection during the pump stroke.
FIG. 2 is a diagrammatic illustration of the pump bushing and plunger of the prior art injector of FIG. 1, the view of the pump bushing or cylinder being a cross-section taken from line 2—2 in FIG. 1, and the plunger being removed from the bushing but having the same lengthwise position (full retraction) and the same rotative position (but now viewed from a new perspective) relative to the bushing as it does in FIG. 1, such rotative position being that at which there will be no injection during the pump stroke.
FIG. 3 is a diagrammatic illustration similar to FIG. 2 but showing a modified bushing or cylinder and modified pump plunger which may be employed in the practice of the invention. Again, the plunger is shown removed from the bushing but is shown in lengthwise position relative thereto corresponding to full retraction, and the plunger is also shown in that rotative position relative to the bushing at which there will be no injection during the pump stroke.
FIG. 3X is a fragmentary cross-sectional view taken from line 3X—3X in FIG. 3.
FIG. 3Y is a broken-out enlarged view taken from line 3Y—3Y in FIG. 3X.
FIG. 4 is a diagrammatic illustration similar to FIG. 3 but showing a another combination of bushing or cylinder and modified pump plunger which may be employed in the practice of the invention. Again, the plunger is shown removed from the bushing but is shown in lengthwise position relative thereto corresponding to full retraction, and the plunger is also shown in that rotative position relative to the bushing at which there will be no injection during the pump stroke.

In order that the environment in which the invention may be employed may be most readily understood by the reader, whether familiar with the art or not, a simplified conventional diesel locomotive unit injector of a well-known type will first be described in some detail. Such a device is shown in cross-section in FIG. 1, and is generally indicated by the reference numeral 10.

The housing-nut 11 of the prior-art nozzle 10 is threaded to and is an extension of the main housing (not shown) for the pump-injection unit. The nut 11 extends from the main housing, which is at the exterior of the engine, through a well in the engine cylinder head into the combustion chamber and is clamped in the engine cylinder head in a well known manner. The housing-nut houses the stacked main injector components described below and threadedly clamps them in their stacked relationship in a well known manner.

The injector has a pump cylinder or bushing 14 and a plunger 15 which define together a pump chamber 16 open at one end for the discharge of fuel during each pump stroke and intake of fuel during each suction stroke. The plunger and bushing include spill means preferably in the form of: a spill port 21 (also referred to as the inlet port) formed in the bushing and an associated port-closing edge or control edge 23 formed on the isrplunger; also a spill port 22 formed in the bushing and an associated port-opening edge or control edge 24 formed in the plunger. (A port such as the port 21 is commonly referred to as an inlet port because it acts as the principal inlet when incoming fuel is sucked through it into the recess 25 and hence into the pump chamber 16 during the return or fuel-intake stroke of the plunger. However, in the present disclosure the port 21, and other similar ports referred to above and to be referred to below, have been and will be generally be referred to as spill ports, since that is their principal function during the advance stroke of their associated pump plunger.)

The spill port 21 leads from a low-pressure fuel supply (not shown), and the port 22 is connected to a low-pressure fuel return system (not shown). The spill ports 21 and 22 are 180 degrees removed from each other, and the spill port 21 is therefore seen in phantom in FIG. 2. The edges 23 and 24 define a relief or recess 25 in the plunger exterior, and such recess communicates through a cross-hole 26 with a bore 27 which forms a hollow interior of the plunger. The bore opens through the distal face of the plunger, so that the recess 25 and the pump chamber 16 are in fluid communication.

The nozzle has an injection valve 18 with differentially sized guide and seat so that there is a fixed relationship between the valve opening and the valve closing. During the pump stroke, until the port-closing edge 23 of the plunger covers the port 21, high pressure cannot be generated because fuel is free to escape back through the port 21 to the low-pressure fuel supply system. Similarly, after the port-opening edge 24 of the plunger uncovers the port 22, high pressure cannot continue to be generated because fuel is free to escape through the port 22 to the low-pressure fuel supply system. However, between these two events (covering of the port 21 and uncovering of the port 22), that is, during such time as both ports are blocked during the pump stroke, high-pressures within the pump chamber may be generated. Upon closing of the port 21, a high-pressure wave is generated which travels past a check valve 28 and through appropriate ducting into the cavity 32 where the wave acts on the conical differential area 19 of the injection valve 18 to lift the valve off its seat against the force of the spring 29 to begin injection.

The valve stays lifted during the time fuel is being delivered at a pressure higher than the closing pressure of the injection nozzle. When the control edge 24 uncovers the port 22, the pressure in pump chamber 16 drops to fuel return pressure and the check valve 28 seats, sealing the fuel transport duct leading to it from the pump chamber 16. At the same time, the pressure in the nozzle fuel chamber 32 drops rapidly to below the valve closing pressure, the valve closes, and injection ends.

The portion of the pump stroke from the closing of the port 21 to the opening of the port 22 may be referred to as the injection portion of the pump stroke.

In a well known manner, the angular position of the plunger 15 is changed by a control rack (not shown) to control the amount of fuel delivered with each stroke of the plunger 15 by varying the positions in the stroke at which the ports 21 and 22 are respectively closed and opened. The port-closing and port-opening edges have different helix angles, so that the interval between port closing and port opening is increased as the angular position of the plunger and the two edges around the axis of the plunger is adjusted throughout a range of adjustment to increase the injection portion of the pump stroke throughout a corresponding range of engine loads.

As indicated above, in FIGS. 1 and 2 the plunger 15 is shown at full retraction and at the adjusted angular position where there will be no injection during the pump stroke, that is, the port 22 starts opening as soon as the port 21 closes.

EMBODIMENTS OF THE INVENTION

Figures 3A, 3B, 4A, 4B, 4C:
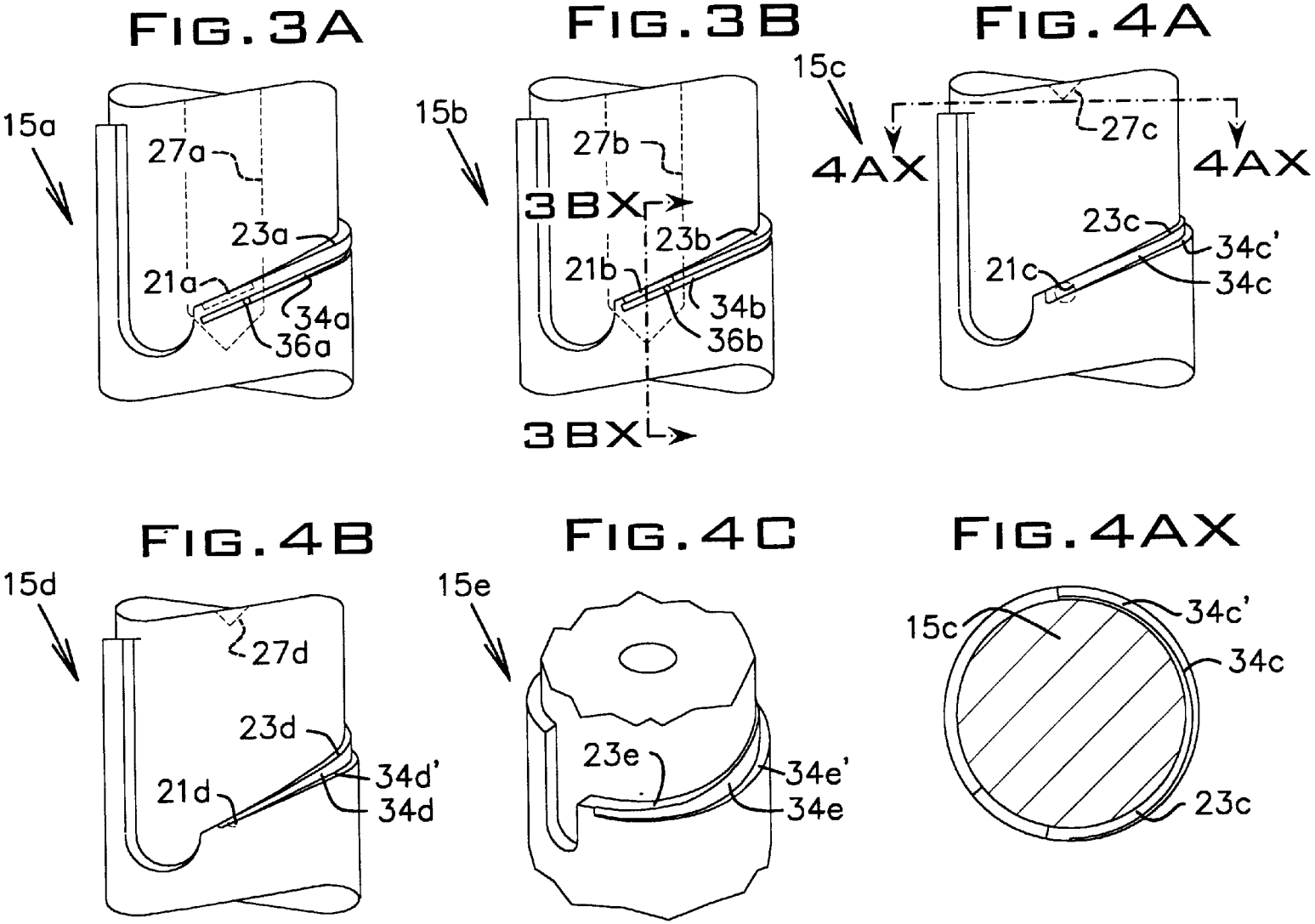
FIG. 3A is a fragmentary view on an enlarged scale showing part of the plunger seen in FIG. 3 including its port-closing edge edge and the associated bushing spill port (the "inlet port"), the parts being illustrated in the same relative rotative position as in FIG. 3 but at the lengthwise position of the plunger relative to the bushing where such spill port ("inlet port") first just closes during the fuel delivery stroke of the plunger.
FIG. 3B is a view similar to FIG. 3A showing another structurally similar embodiment which however is adapted to the joining of pilot injection and main injection rather than the separation of the two as in the embodiment of FIGS. 3 and 3A.
FIG. 4A is a fragmentary view on an enlarged scale showing part of the plunger seen in FIG. 4 including its port-closing edge and the associated bushing spill port (the "inlet port"), the parts being illustrated in the same relative rotative position as in FIG. 3 but at the lengthwise position of the plunger relative to the bushing where such spill port first just closes during the feed fuel delivery stroke of the plunger.
FIG. 4B is a view similar to FIG. 4A showing the same portion of a similar but modified plunger at the lengthwise position of the plunger relative to the bushing where the associated bushing spill port ("inlet port") first just closes during the fuel delivery stroke of the plunger.
FIG. 4C is a fragmentary isometric view showing the same portion of another similar but modified plunger. The associated spill port is not shown in FIG. 4C.
Figure 3B:
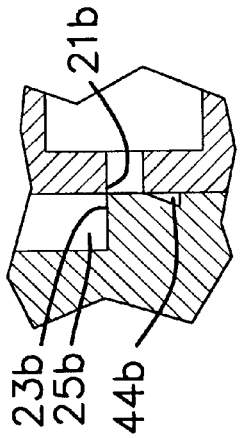
Figure 3B:
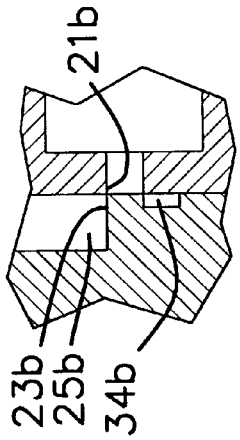

A plunger and bushing assembly embodying the invention is shown in FIGS. 3 and 3A and related sectional views. In this embodiment, pilot injection is separated from main injection.

A bushing 14*a* is provided with spill ports 21*a* and 22*a*. In this embodiment, the spill port 21*a* (which may also be referred to as the inlet port) is formed as a slot which, as shown, is preferably oriented at the same angle as the associated control edge 23*a*. The port 21*a* is removed 180 degrees from the port 22*a* and is shown in phantom in FIG. 3. The port 21*a* may be formed by drilling a flat-bottomed hole through the majority of the thickness of the bushing wall, and then forming the port proper as the slot 21*a* by EDM (electrodischarge machining) or ECM (electrochemical machining) through the remaining thickness of the bushing wall between the flat bottom of the drilled hole and the bushing bore.

As seen most clearly in FIG. 3A, an off-edge constant-depth groove 34*a* is formed in the plunger 15*a*. The groove 34*a* extends along and in association with the control edge 23*a* throughout a considerable portion of the control edge; in the illustrated embodiment the groove extends along substantially the entire operative portion of the control edge 23*a*, that is, the groove at least extends to all points along the control edge where there will be interaction between the control edge and the port 21*a* at some setting of the plunger stroke from zero fuel delivery to full load.

The groove 34*a* in conjunction with the spill port 21*a* produces a pilot injection separated from main injection by spilling fuel from the pump chamber 16 for a fixed portion of the plunger stroke during the initial portion of the injection portion of the pump stroke after the pilot fuel delivery is completed as more fully described below in connection with the discussion of FIGS. 5–9.

The groove 34*a* communicates with the associated pump chamber (not shown) which is immediately above the face (not shown) of the plunger via one or more ducts 36*a* (FIGS. 5–9) which connect the groove 34*a* to the central plunger bore 27*a* which in turn leads, through the face of the plunger, to the pump chamber.

Figure 5:
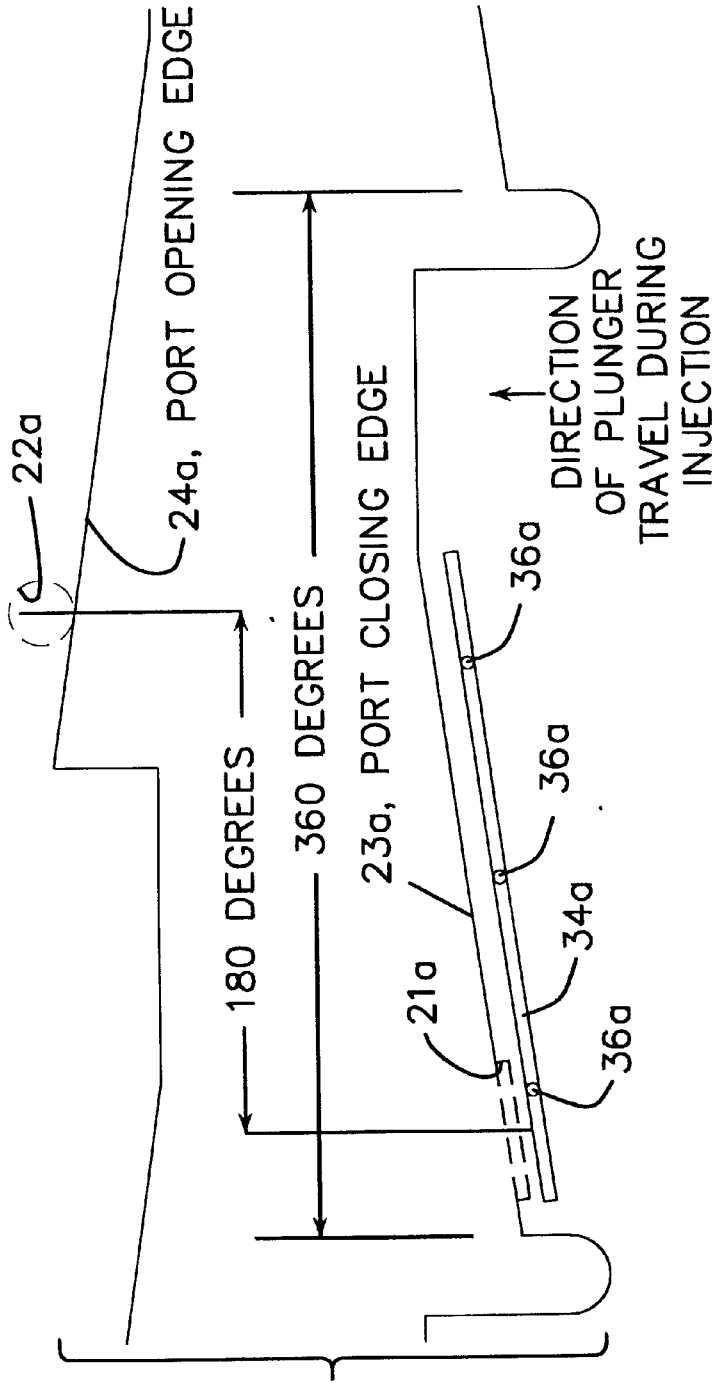
FIGS. 5—9 are development views or diagrams applicable to the embodiment of the invention illustrated in FIGS. and 3A and showing the relationship between the ports of the bushing and the port-closing and port-opening edges of the plunger for various positions of the plunger in several operating modes of the injector.
Figure 5A:
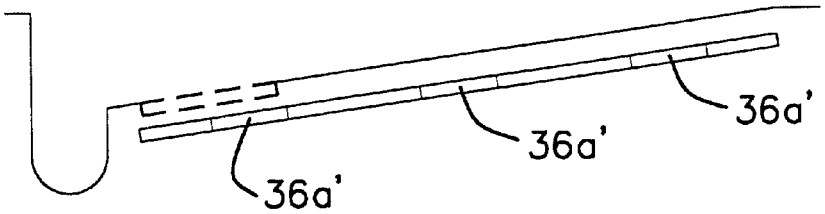
FIG. 5A is a view similar to a portion of FIG. 5 showing a preferred alternative in one aspect of the ducting arrangement.

While the ducts 36*a* are shown as small circular holes for simplicity of illustration, they may instead comprise one or more slots 36*a*' extending lengthwise of the groove and machined through the bottom of the groove and communicating between it and the plunger bore, as shown in FIG. 5A, or they may have other shapes assuring adequate flow capacity between the groove and the plunger bore.

The depth of the spill groove 34*a* is governed by the cross-sectional spill area of the groove required to terminate the pilot injection when the groove opens the spill port 21*a* (which according to traditional terminology may also be referred to as the "inlet port" of the p&b assembly, as above noted.)

In the embodiment illustrated in FIGS. 3 and 3A, both edges of the groove 34*a* are parallel to the control edge 23*a* and the groove is spaced from the control edge by a distance greater than the width of the port 21*a*, as best seen in FIGS. 3A and 5. This produces a pilot injection preceding and separated from the main injection by a predetermined number of crank degrees. In some instances, it may be advantageous to form one or the other edge, or both edges, of the groove 34*a* so that it/they is/are not parallel to the control edge 23*a*, but in general the helix angle of the groove one the one hand and the port-closing edge on the other are sufficiently similar that the groove and the edge remain associated for operation together in the manner described throughout a range of operating mode settings.

FIG. 5 shows the embodiment of FIGS. 3 and 3A at zero fuel delivery position. Note that the bushing spill port 22*a* starts to be opened by the port-opening edge 24*a* just as the bushing inlet port 21*a* (shown in phantom) is closed by the port-closing edge 23*a* so that no fuel is delivered by the plunger.

Figure 6:
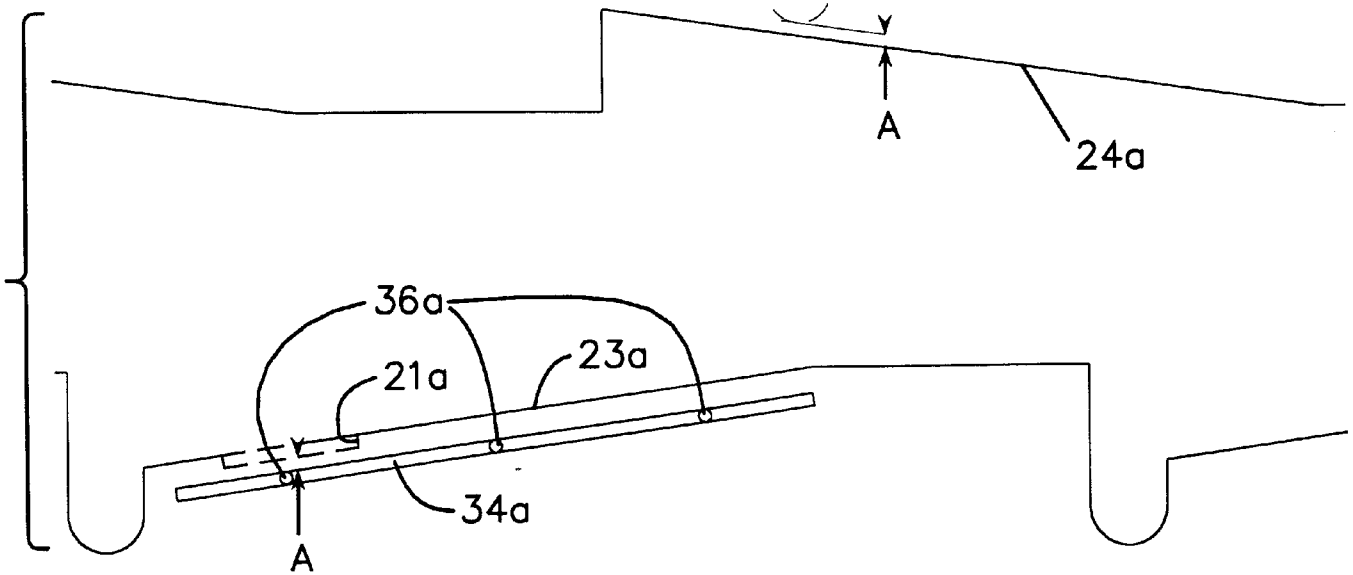

FIG. 6 shows the plunger control edges and bushing ports in the pilot fuel delivery mode. The fuel control has rotated the plunger for increased fuel delivery, so that, as viewed in FIG. 6 as compared to FIG. 5, the control edges 23*a* and 24*a* have moved leftward relative to the bushing ports. The pilot delivery begins after the bushing port 21*a* is closed and the plunger continues to move forward; the pilot delivery continues while the plunger moves through distance A and is terminated when the groove 34*a* opens the bushing port 21*a*. Simultaneously, within the manufacturing tolerances, the spill port 22*a* is opened by the port-opening edge 24*a*.

Figure 7:
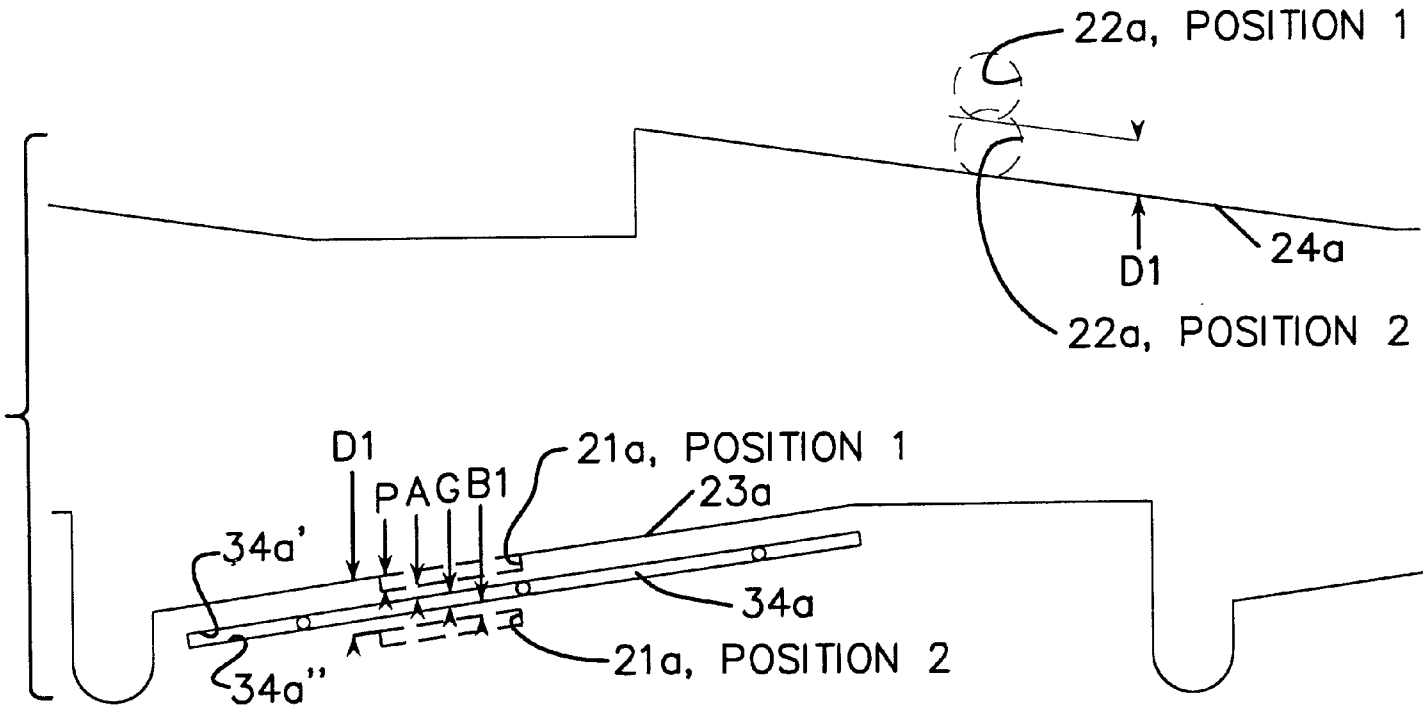

FIG. 7 shows the plunger control edges 23*a* and 24*a* and the bushing ports 21*a* and 22*a* in the idle operating mode. The fuel control has further rotated the plunger relative to the bushing for further increased fuel delivery. Positions 1 and 2 of each bushing spill port relative to the plunger are labelled in FIG. 7.

At relative position 1 of port 21*a*, the control edge 23*a* of the plunger has just covered and closed the port 21*a*. The spill port 22*a*, in its corresponding relative position 1, is covered by the port-opening edge 24*a* and will remain covered until the plunger advances through the distance D1.

The pilot fuel quantity is delivered as the plunger continues to advance. As it completes its movement through the distance A, the edge 34*a*' of the groove 34*a* just starts to open the spill port 21*a*. As the plunger continues to advance through the a distance P+G, equal to the combined widths of port 21*a* and groove 34*a*, pressurized fuel is spilled into the groove 34*a* and thence through the bushing spill port 21*a* into the low supply system. Fuel continues to be diverted through the groove 34*a* and port 21*a* until travel through the distance P+G is completed and the edge 34*a*" of the groove 34*a* just covers the port 21*a*. This terminates spill and therefore terminates the fuel delivery cut-off period between the pilot and main injections. As the plunger continues to move forward, the main injection portion of the fuel delivery effective stroke occurs through distance B1. As the plunger completes its movement through distance B1, the port-closing edge 24*a* completes its movement through distance D1 putting port 22*a* in its relative position 2 where it starts being opened by port-closing edge 24*a*, terminating the idle fuel delivery.

Note that idle fuel delivery actually occurs through a stroke distance A+B1 in FIG. 7 and the portion of the plunger stroke involved in the idle fuel delivery from initial port closing to final port opening (idle fuel delivery effective stroke) is the distance D1 which equals P+A+G+B1.

Figure 8:
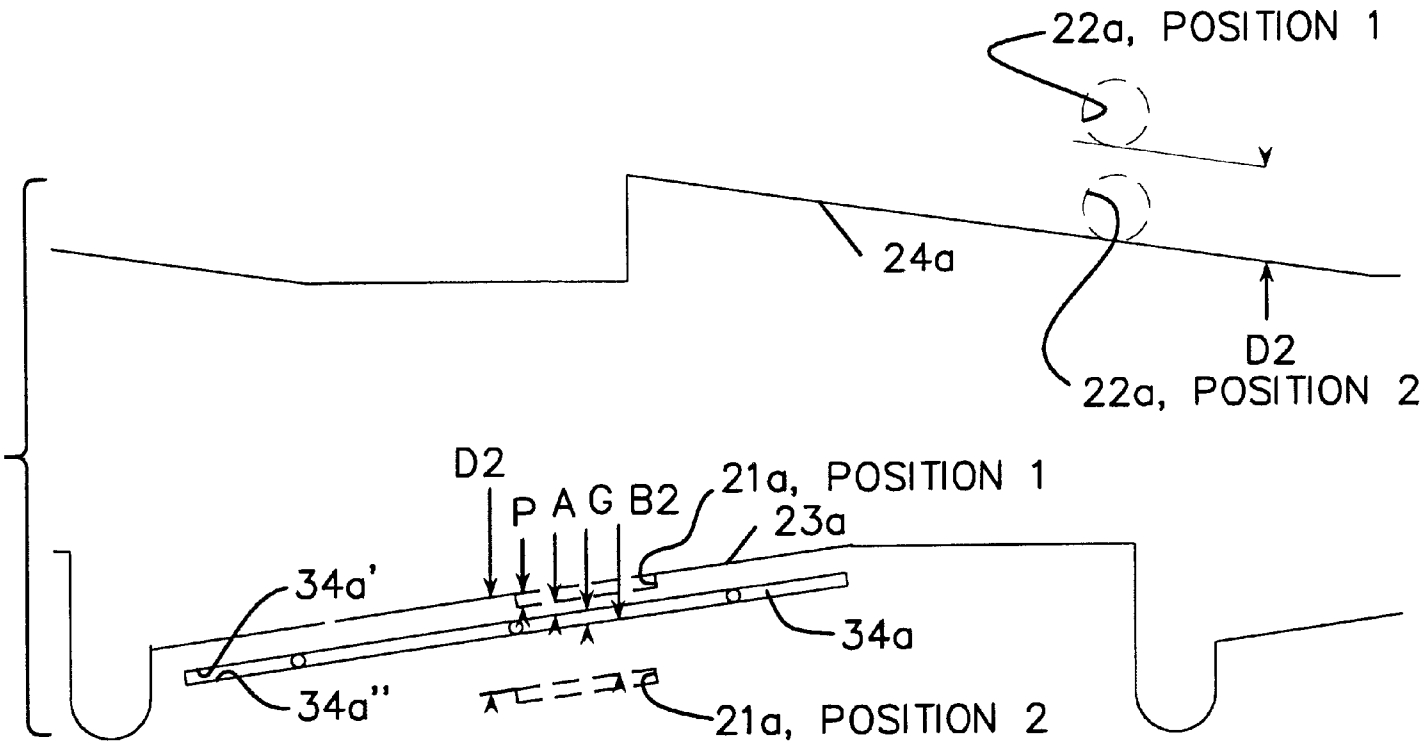
Figure 9B:
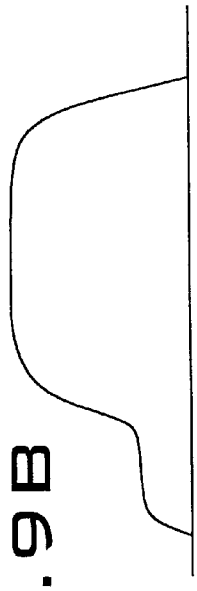
FIGS. 9A and 9B are hypothetical plots of rates of injection on the vertical axis (expressed, say, in cubic millimeters per crank degree) against plunger position (crank degree) on the horizontal axis.
Figure 9A:
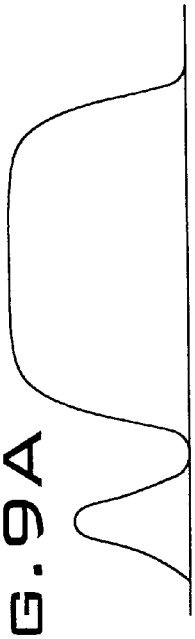
Figure 9:
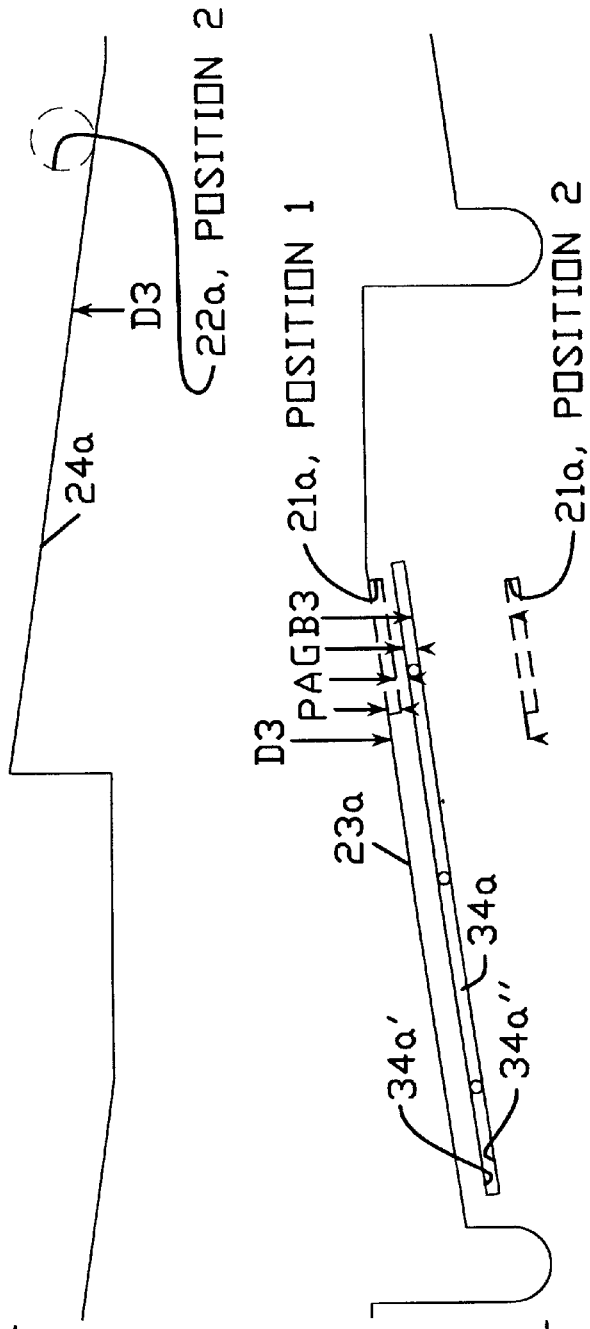

The fuel delivery process is identical for all fuel injection quantities from idle to full load, as shown in FIGS. 7–9. All the fuel metering functions controlled by P, A and G are identical for all engine loads. In other words, P, A and G ir are constants. The only variables are the "B" and "D" distances. These vary with load, so that B1, B2 and B3, seen respectively in FIGS. 7–9, are increasingly large, as are D1, D2 and D3. In other words, the "B" and "D" distances very with load, and increase as the plunger is rotated in the bushing in the direction of increased fuel delivery.

The groove 34*a* can be made to produce a longer or shorter dwell (total bypass of fuel) at idle or full load by making the groove wider or narrower at either position, should such a condition be desired. Also, the pilot quantity can be made smaller or larger at full load than at idle by altering the groove lead in relation to the port-closing edge. Such variations permit optimum reduced initial rate characteristics for unit injectors and also unit pump systems which employ a separate nozzle and holder assembly supplied by connecting high-pressure tubing leading from the pump.

The off-edge groove embodiment illustrated in FIG. 3B is similar in physical form to the off-edge groove embodiment of FIGS. 3 and 3A, but pilot injection is not separated from main injection. Both edges of the groove 34*b* are parallel to the control edge 23*b*. However, the groove 34*b* is spaced from the control edge 23*b* by a distance equal to the width of the port 21*b*, as best seen in FIGS. 3B and 3BX. This produces a reduced rate pilot injection not separated from the main injection. This is accomplished by controlling the bypass leakage quantity by means of the depth of the groove 34*b* to the extent required to produce the desired reduced rate of fuel delivery during the pilot phase of the injection.

Also, to compensate for the increased leakage that takes place in those applications where the engine speed decreases with engine load, the groove 34*b* varies in depth from one end to the other, with the greatest depth being at the full load position. The corresponding groove in other embodiments may also be shaped with varying depth in such applications.

One such application of the invention is use in diesel locomotive engines. Such engines typically drive electric generators which in turn supply power to tractor motors which turn the locomotive wheels. This lack of direct mechanical drive between engine and wheels allows the engine to operate in an essentially steady state mode in a number of different power settings or notches. Current locomotives have eight power notches and an idle setting. At each notch setting the engine is governed at a different speed, ranging from maximum at full load to a minimum at idle.

Use of a p&b assembly employing an edge groove such as the groove 34*b* whose depth varies in the manner described accomplishes the desired object in such an application. For an injector operating a variable speeds, if the spill groove on the plunger had a fixed depth over its entire length such that the bypass leakage path area is the same at high speed (full load) as it is at low speed (low load), there would be greater bypass leakage at low speed because the time for the spill groove to travel over the auxiliary spill port in the bushing is greater as the engine speed decreases; this is so even though the plunger travel is the same in engine cam degrees. This increased bypass leakage through the auxiliary spill port would result in the reduced initial rate portion (pilot portion) of the injection being reduced to zero at some intermediate speed (load).

Therefore, the depth of the spill groove on the plunger is made to that level at which the full bypass leakage quantity is made the same at each notch (speed) position.

The relationships of the control edges and ports for the off-edge groove design of FIG. 3B over the load and speed range are the same as those portrayed in FIGS. 5–9 for the plunger 15*a* of FIGS. 3 and 3A except that at all plunger operating positions the groove 34*b* starts to open as the control edge 23*b* just closes the port 21*b* (i.e., the dimension of constant distance A shown in FIGS. 5–9 would be zero), and also the amount of flow constriction is affected by the varying cross-section of the groove 34*b* due to its varying depth, which is greatest at full load position. In the FIG. 3B construction, the length (duration) of the pilot portion or reduced rate portion of the injection is governed by the combined width (axial dimension) of the spill port 21*b* (shown in phantom) and spill groove 34*b*.

The embodiment of FIG. 3B is capable (as is the embodiment of FIG. 3A) of producing an injection in which the initial wave generated is as high as which would be produced without plunger spill. As seen in FIGS. 3B and 3BX, the control edge 23*b* of plunger 15*b* is at the point of closing the port 21*b* just as the groove 34*b* is at the point of opening the same port. This simultaneity occurs because the distance between the control edge 23*b* and the closest edge of the groove 34*b* is equal to the width of the port 21*b* within manufacturing tolerances, both measured axially or perpendicularly to the respective edges.

FIG. 3BY shows a construction similar to that shown in FIG. 3B, the difference being that in FIG. 3BY the groove 34*b* shown in FIG. 3B is replaced by a groove 44*b* which varies in depth across its width in the manner shown. This or other across-the-groove-width depth variation in either the off-edge or on-edge groove designs may enhance desirable flow initiation or cut-off characteristics in some applications.

A plunger and bushing assembly of an on-edge groove design embodying the invention is shown in FIGS. 4 and 4A and the related sectional view (FIG. 4AX). A bushing 14*c* is provided with spill ports 21*c* and 22*c*. In this embodiment as illustrated, the spill port 21*c* (seen in phantom) is a round hole for purposes of illustration, although other shapes of port can be used to produce the optimum desired initial rate of injection for any specific engine application.

An on-edge relief groove 34*c* is machined or otherwise formed into the port-closing edge 23*c* of the plunger 15*c* and is bounded by its groove edge 34*c*'. The groove 34*c* varies in depth, with the greatest depth being at the full load position. In the illustrated embodiment, and in all embodiments of the invention where an off-edge or on-edge groove of varying depth is employed, the variation of the depth is preferably continuous (non-stepped) along at least a portion of the length of the groove, and more preferably along at least intermediate portions of the length of the groove, and still more preferably along a majority of the length of the groove. In many applications, in any embodiment where there is varying depth of the groove, it is further preferable that the depth vary continuously along substantially the entire length of the groove, as shown in FIG. 4AX.

The varying depths of the groove 34*c* are selected as those required to control the amount of fuel spilled at each operating condition of the injector during the early phase of the injection period to deliver the fuel to the nozzle at the reduced rate desired for the controlled engine combustion process. The leakage path past the relieved port becomes effective immediately at or shortly after the plunger advances to the normal position of "port closing" depending upon the shape of the relief ground and the cylindrical surface associated with the port-closing edge. Preferably the form of this relief is such that the initial pressure wave is essentially as high as it would be without the fuel bypass leakage.

The relationships of the plunger control edges and ports over the load range of the on-edge plunger and bushing design of FIGS. 4 and 4A are shown in FIGS. 10–14. As mentioned above, although a round spill port 22*c* is shown for purposes of illustration, other shapes can be used to produce the optimum desired initial rate of injection for specific engine applications. The portrayal of the control edges and ports over the load range is shown in a manner that applies generally to all possible combinations of control edge forms and port shapes that can be used.

Figure 10:
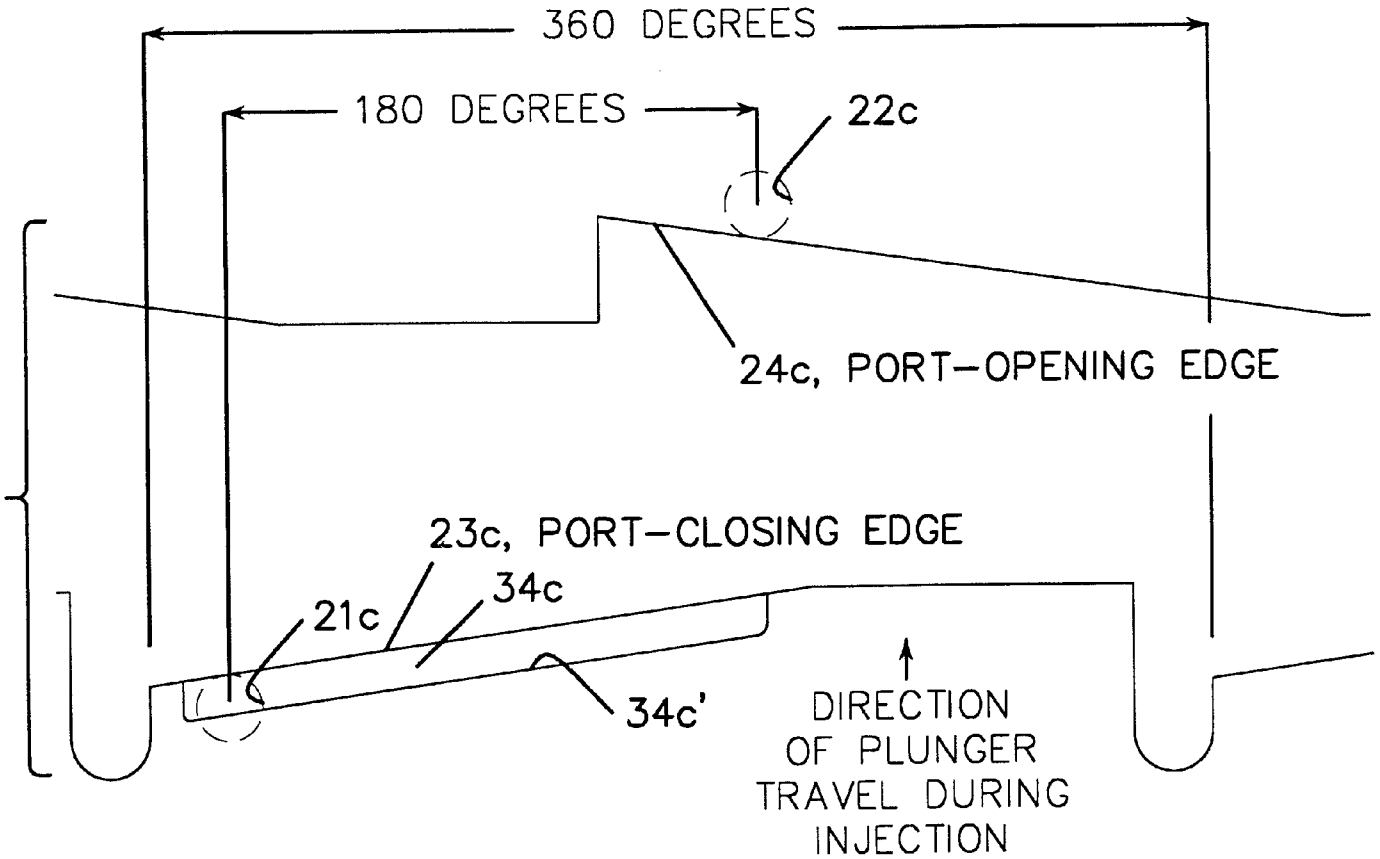
Figure 11A:
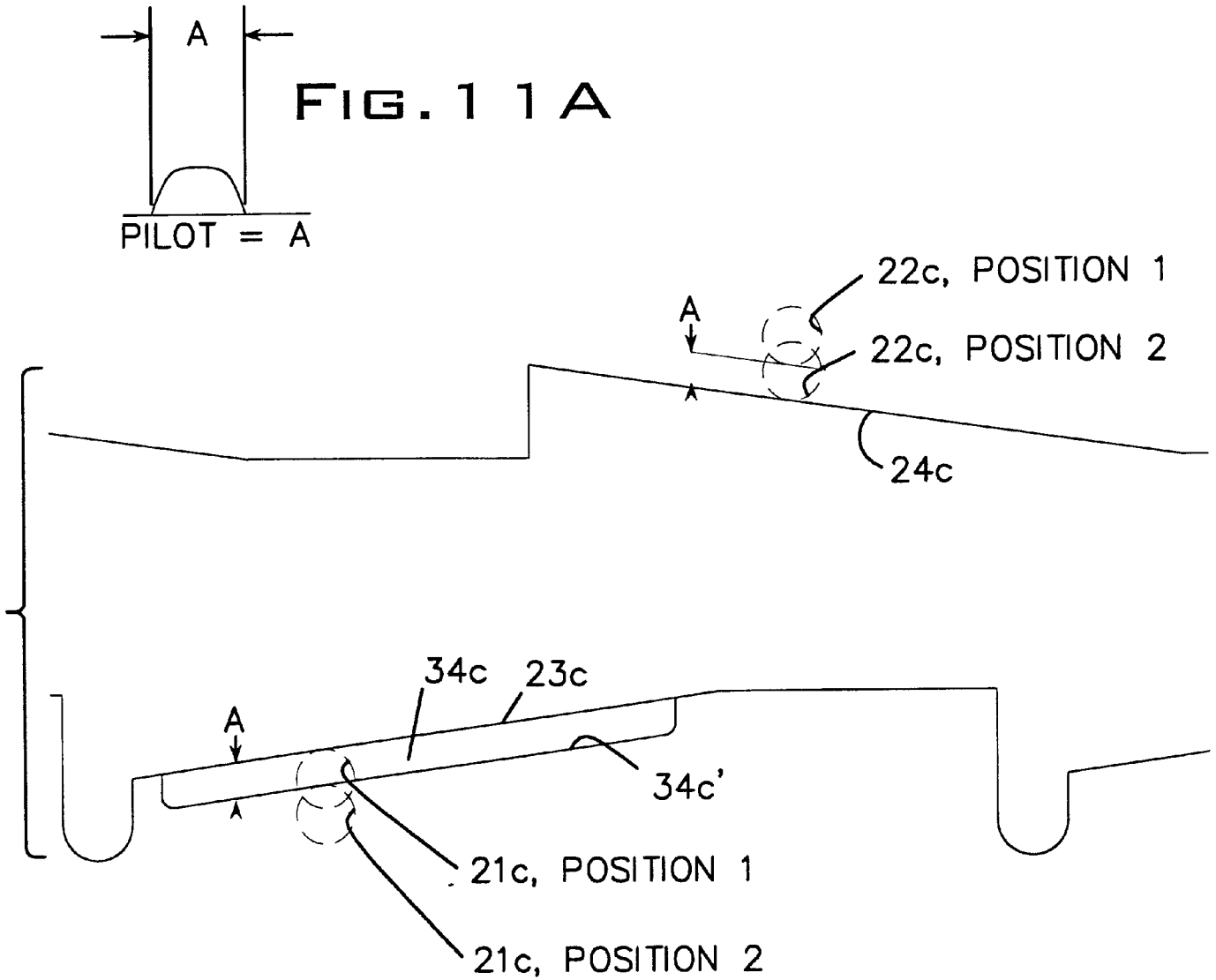
Figure 12A:
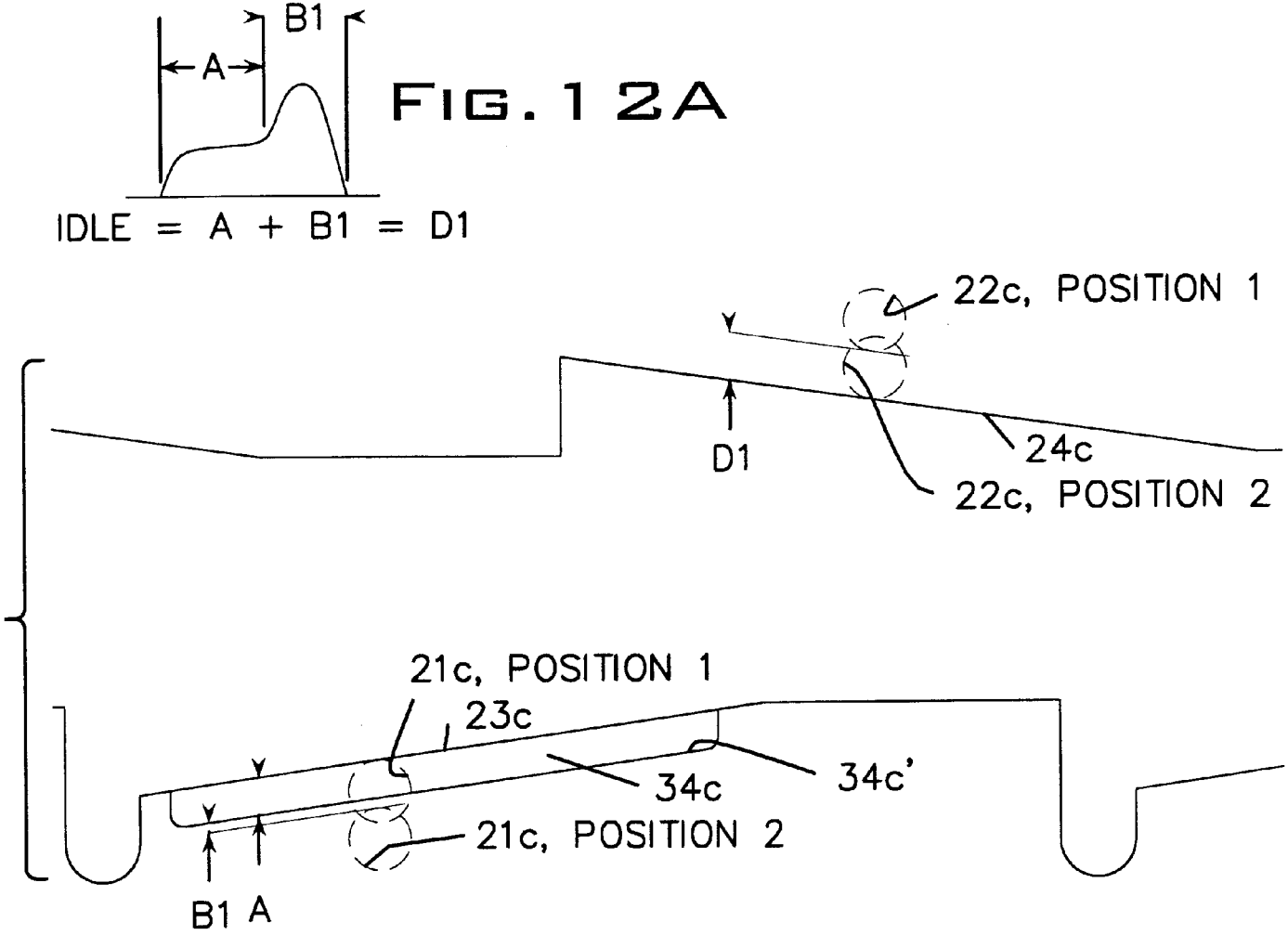
Figure 13A:
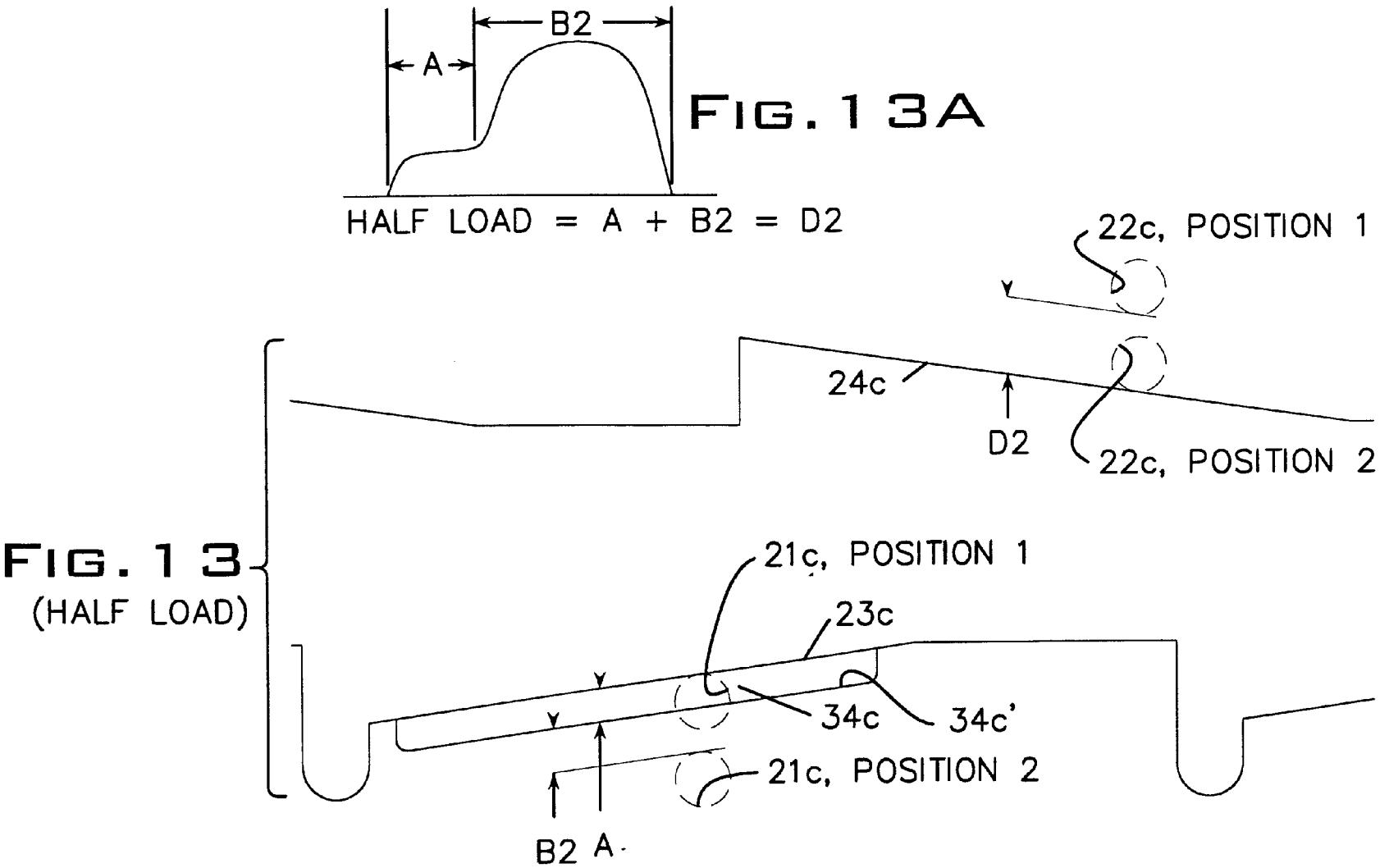

FIG. 10 shows the control edges and the bushing ports in the zero fuel delivery operating mode. Spill port 21*c* is just covered by the port-closing edge 23*c* as the port 22*c* is just being opened by the port-opening 24*c*, thus terminating the possibility of any fuel being delivered as the plunger continues to move forward, i.e., in the injection direction.

FIG. 11 shows the relationship of the ports and control edges in the pilot (reduced initial rate) fuel delivery mode. In FIG. 11 as compared to FIG. 10, the control edges have been moved leftward relative to the ports, the control means having rotated the plunger in the direction of increased fuel delivery. In "position 1" of the port 21*c* relative to the moving port-closing edge 23*c*, the moving control edge 23*c* has just covered the port 21*c*. In corresponding "position 1" of port 22*c* relative to the moving control edge 24*c*, the edge 24*c* still has the distance A to go before beginning to uncover the port 22*c*. This "position 1" of each port defines the beginning of pilot fuel delivery.

In "position 2" of the port 21*c* relative to the moving control edge 23*c*, the moving relief edge 34*c*' has just covered the port 21*c*. In corresponding "position 2" of the port 22*c* relative to the moving control edge 24*c*, the control edge 24*c* is just beginning to uncover the port 22*c*, thus terminating fuel delivery. The distance A indicated in FIG. 11 defines that portion of plunger travel that produces the pilot fuel delivery. The distance A corresponds to the duration of the pilot fuel delivery period during which fuel is bypassed through the groove 34*c* cut in the control edge 23*c*. The rate of fuel injection into the engine through the distance of plunger travel is graphed in FIG. 11A. The pilot delivery is not sufficient to operate the engine in any mode but is shown only to demonstrate how the pilot delivery is generated at all operating modes of the engine.

As mentioned earlier, for engine applications in which the engine speed decreases with load, for the same leakage path area, there is greater bypass leakage at low load (speed) because the time for the plunger to travel the distance A is greater as the engine speed decreases even though the plunger travel in engine cam degrees is the same. For this reason the leakage bypass relief groove 34 is formed with a depth that varies, with the depth decreasing as the load (speed) decreases and the shallowest path at idle so that the pilot quantity remains the same or at least approximates a constant value over the load and speed rrange. For engine applications where engine speed does not vary with load, the bypass relief groove may be of constant depth.

FIG. 12 shows the relationship of the ports and control edges for the "idle" fuel delivery mode. As viewed in FIG. 12, the control edges are moved further leftward relative to the ports as the control mean rotates the plunger in the direction of increased fuel delivery. In this mode, in the "position 2" of the port 21*c* relative to the moving port-closing edge 23*c*, the pilot fuel delivery via the on-edge groove 34*c* has already been completed as described above and the plunger has advanced the additional distance B1 beyond the closing of the port 21*c* by the relief edge 34*c*'.

At the same time, the port-opening edge 24*c* has completed the advance of distance D1 to the point where, at "position 2" of port 22*c* relative to the moving port-closing edge 24*c*, the port 22*c* is just being opened, terminating fuel delivery. Thus the distance D1=A+B1 indicated in FIG. 12 defines that portion of plunger travel that produces the idle fuel delivery effective stroke. The rate of fuel injection into the engine through the distance D1 (or A+B1) of plunger travel is graphed in FIG. 12A.

FIG. 13 shows the relationship of the ports and control edges for the "half load" fuel delivery mode. As viewed in FIG. 13, the control edges 23*c* and 24*c* are moved still further leftward relative to the ports 21*c* and 22*c* as the control means rotates the plunger in the direction of increased fuel delivery. Here again, the pilot fuel delivery has already been completed as described above in connection with FIG. 11 and the plunger has advanced the additional distance B2 (greater than the distance B1 in FIG. 12) beyond the closing of the port 21*c* by the relief edge 34*c*'.

At the same time, the control edge 24*c* has completed the advance of distance D2 (greater than the distance D1 in FIG. 12) to the point where the port 22*c* is just being opened, terminating fuel delivery. The rate of fuel injection into the engine through the new distance D2 (or A+B2) of plunger travel is graphed in FIG. 13A.

Figures 14, 14A:
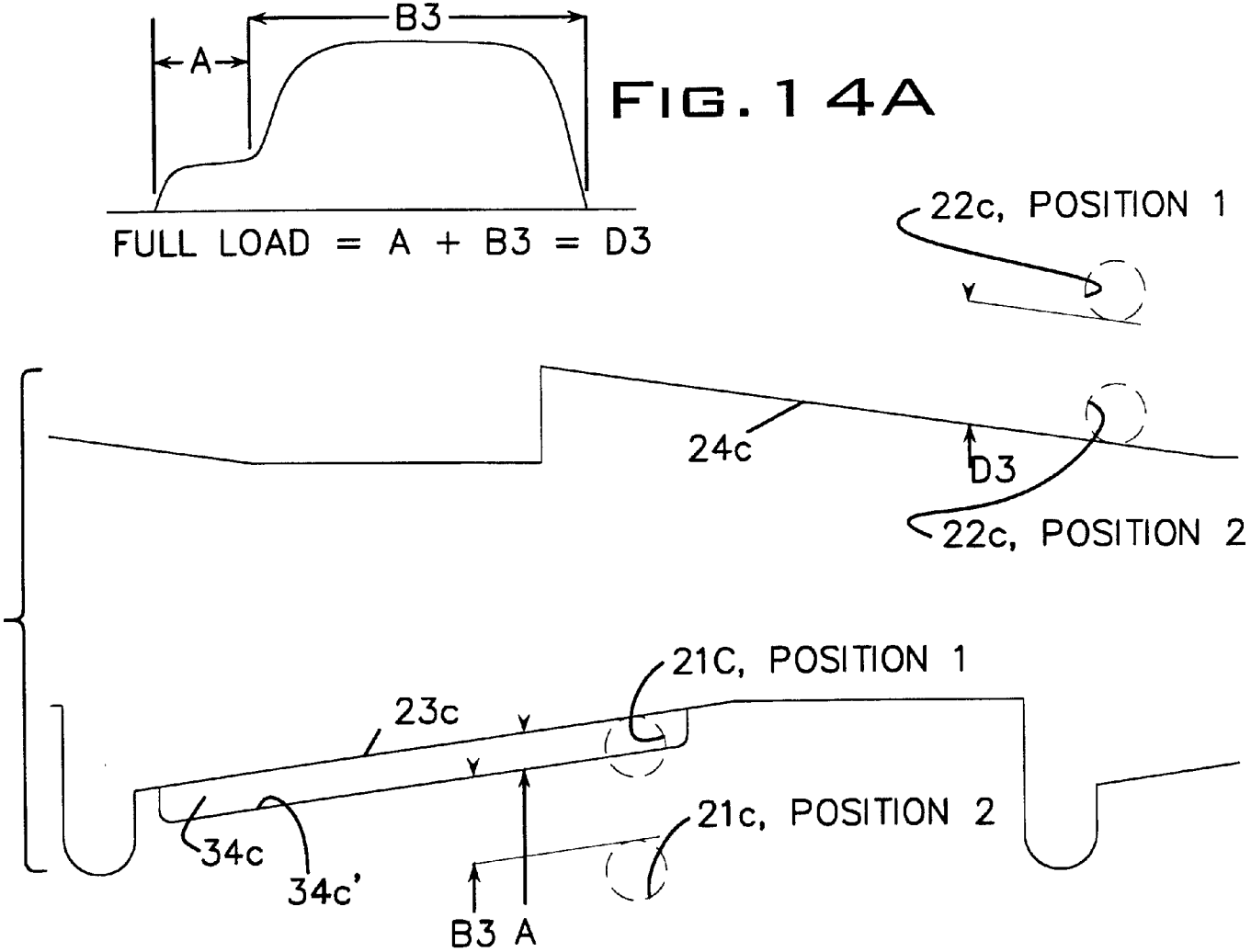

The same operating relationships apply for full load delivery shown in FIG. 14 and all other conditions between idle and full load.

FIG. 4B shows an on-edge groove embodiment in which the groove 34*d* increases in width from shut-off or zero delivery position to full load to produce a shorter reduced rate of injection at idle and part load should it be desired. That is, the interval between crossing of the spill port 21*d* by respectively the port-closing edge 23*d* and the relief edge 34*d*' increases as the plunger is rotated to increase the load setting. In an alternative construction, this variance may be reversed, with the groove decreasing in width from shut-off to full load to produce longer reduced rates of injection at the lower loads.

FIG. 4C shows an on-edge groove embodiment in which the groove 34*e* increases in both width and depth as the plunger is rotated to increase the load setting, so that the rate of pilot injection remains the same but the duration of pilot injection increases with increased load setting. That is, not only does the interval between crossing of the spill port (not shown) by respectively the port-closing edge 23*e* and the relief edge 34*e*' increase as the load setting is increased, but also the groove 34*e* becomes deeper.

Figure 15:
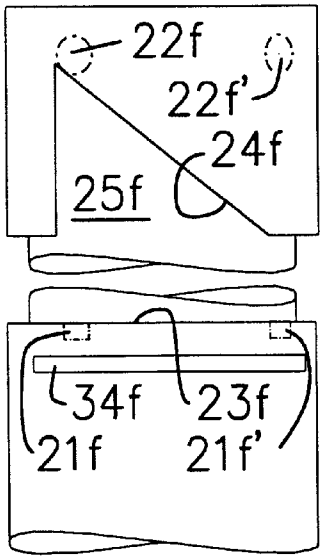

FIG. 15 is a diagrammatic fragmentary showing of another general type of p&b design modified to embody the invention. Such general type of design will recognizable by those skilled in the art as a newer EMD design, as referred to above. For simplicity of illustration, the bottom half of FIG. 15 is shown rotated 180 degrees from the top part; in other words, the top and bottom portions of FIG. 15 view the plunger from opposite sides. For further simplicity of illustration, only the spill ports formed in the bushing are shown (in phantom, the spill ports in the illustration being understood to be located on the same side of the plunger as the viewer); the bushing itself is not illustrated; also, the internal ducts in the plunger are not shown. Two positions of each of the spill ports relative to the plunger are shown: the two spill ports are identified by the reference numbers 21*f* and 22*f* in their zero fuel delivery positions; in their full load delivery positions they are identified by the reference numbers 21*f*' and 22*f*'.

In this general type of design, the port-closing edge 23*f* has a helix angle of zero. The port-opening edge 24*f* and the port-closing edge 23*f* define the recess 25*f* which is connected via a central bore (not shown) to the pump chamber above the face or top of the plunger.

According to the invention, an off-edge groove 34*f* is provided, and is joined via internal ducts (not shown) to the plunger bore (not shown) and therefore to the pump chamber. The operation of this embodiment is similar to, and should be obvious from the foregoing description of, the embodiment of FIGS. 3 and 3A.

Figure 16:
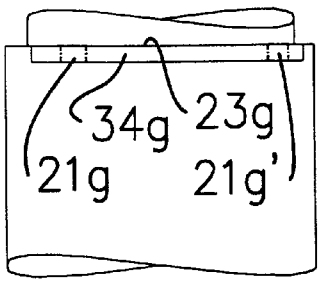
FIGS. 15 and 16 are fragmentary diagrammatic views on a scale similar to that of FIG. 3A showing the invention embodied in another known type of p&b assembly which may be referred to as the "new EMD" type plunger.

FIG. 16 is a view similar to the bottom half of FIG. 15 but showing use of an on-edge groove 34*g* instead of the off-edge groove 34*f* of FIG. 15. Otherwise, the p&b devices of FIGS. 15 and 16 may be the same. The operation of this embodiment is similar to, and should be obvious from the foregoing description of, the embodiment of FIGS. 4 and 4A.

Figure 18:
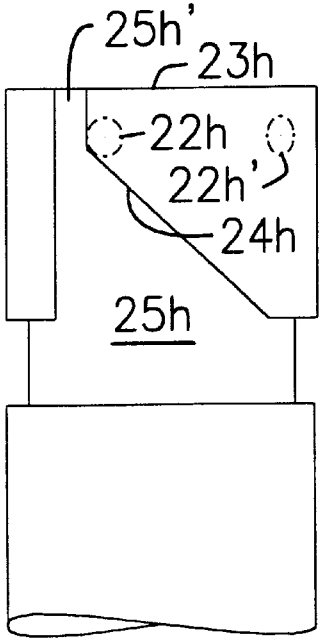
Figure 17:
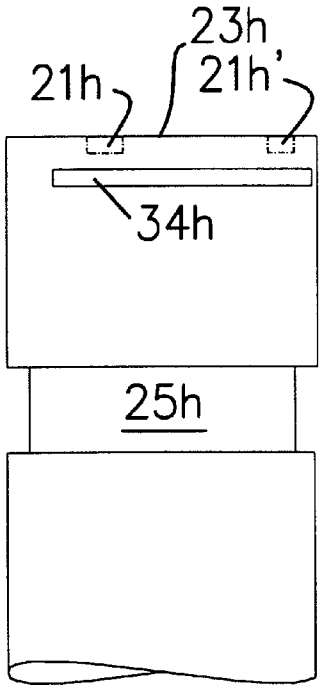

FIGS. 17 and 18 provide a diagrammatic fragmentary illustration of another general type of p&b design modified to embody the invention. Such general type of design will recognizable by those skilled in the art as a certain GE design, as referred to above. FIGS. 17 and 18 view the same plunger from opposite sides. For simplicity of illustration, only the spill ports formed in the bushing are shown (in phantom); they are between the viewer and the plunger; the bushing itself is not illustrated. Two positions of each of the spill ports relative to the plunger are shown: the two spill ports are identified by the reference numbers 21*h* and 22*h* in their zero fuel delivery positions; in their full load delivery positions they are identified by the reference numbers 21*h*' and 22*h*'.

In this general type of design, the port-closing edge 23*h* has a helix angle of zero and is at the face of the plunger. The exterior plunger recess 25*h* is connected to the pump chamber above the face of the plunger via the exterior groove 25*h*'.

According to the invention, an off-edge groove 34*h* is provided, and is joined via internal ducts (not shown) to the pump chamber. The operation of this embodiment is similar to, and should be obvious from, the foregoing description of, the embodiment of FIGS. 3 and 3A.

Figure 19:
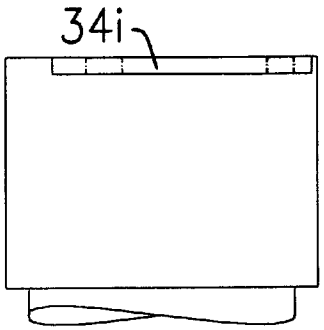

FIG. 19 is a view similar to the top half of FIG. 17 but showing use of an on-edge groove 34i instead of the off-edge groove 34*h* of FIG. 17. Otherwise, the p&b devices of FIGS. 17 and 18 on the one hand and FIG. 19 on the other may be the same. The operation of this embodiment is similar to, and should be obvious from the foregoing description of, the embodiment of FIGS. 4 and 4A.

The embodiments of the invention described above have generally related to unit injectors. The features of the invention can be utilized in any plunger and bushing pump assembly used in fuel injection systems, for example in a three-piece type injection system consisting of pump, tubing and injection assembly.

Spill ports such as ports 21*a*, 21*b*, 21*c* and 21*d*, etc., may be given shapes other than the illustrated circles or rectangles. An elliptical shape may be advantageous as providing a good trade-off between performance and ease of manufacture.

The on-edge and off-edge grooves described above generally extend substantially throughout the operative lengths of their associated port-closing edges and therefore are associated with substantially the entire range of adjustments over all modes from pilot to full load. However, constructions may be provided similar to any of the above-described embodiments but in which the grooves extend only partly along the lengths of their associated port-closing edges. In such a case, the reduced initial flow rate operation as described above will be provided for that part of the range of adjustments that corresponds to the part of the port-closing edge along which the associated on-edge or off-edge groove extends.

The foregoing improvements offer an eminently practical means to substantially reduce nitrous oxides emissions and combustion noise by modifications of diesel fuel injectors. It should be evident that this disclosure is by way of example, and that various changes may be made by adding, modifying or eliminating features without departing from the fair scope of the teaching contained in this disclosure. The invention therefore is not limited to particular details of this disclosure except to the extent that the following claims are necessarily so limited.

What is claimed is:

1. A diesel injector for injecting diesel fuel into an engine chamber in a controlled manner, said injector being of the type including a sleeveless pump comprising a two-piece lengthwise-extending pressure-containing plunger-and-bushing subassembly including a pump bushing and a pump plunger sliding in said bushing, a pump chamber at the distal end of said plunger adapted to contain fuel under low pressure prior to the pump stroke of said pump, said pump plunger being reciprocable in the pump bushing for pressurizing fuel in the pump chamber with a pump stroke having predefined rates of displacement along the stroke length to force a discharge of fuel under pressure, and to force said pressurized fuel from the chamber to open and pass an injection valve during an injection portion of the pump stroke, means for controlling the length of said injection portion of the pump stroke, said means for controlling including a port-closing edge and a port-opening edge associated with ports opening into the plunger-receiving bore of said bushing, said two edges having different helix angles, not excluding a helix angle of zero for one of them, whereby the interval between port closing and port opening in each pumping stroke is increased as the angular position of the plunger and said edges around the axis of the plunger is adjusted throughout a range of adjustment _to increase the injection portion of the pump stroke throughout a corresponding range of engine loads, a groove formed in said plunger and extending along and in association with said port-closing edge at least throughout a portion of the extent of said port-closing edge and at a helix angle, zero or greater, similar to that of said port-closing edge, said groove being thereby associated with a corresponding portion of said range of adjustment, said groove, throughout said corresponding portion of said range of adjustment, interacting with the said port that is associated with said port-closing edge to provide, in each of a succession of plunger strokes at each adjustment within said portion of said range of adjustments, _initial fuel injection at a feed rate lower than that which would obtain in the absence of said groove while remaining fuel injection, following said initial injection in said each stroke, is not so lowered, said groove extending along at least the portions of said associated port-closing edge that are themselves associated with the high end of the range of injection portions of the pump stroke.

2. A diesel injector for infecting diesel fuel into an engine chamber in a controlled manner, said injector being of the type including a sleeveless pump comprising a two-piece lengthwise-extending pressure-containing plunger-and-bushing subassembly including a pump bushing and a pump plunger sliding in said bushing, a pump chamber at the distal end of said plunger adapted to contain fuel under low pressure prior to the pump stroke of said pump, said pump plunger being reciprocable in the pump bushing for pressurizing fuel in the pump chamber with a pump stroke having predefined rates of displacement along the stroke length to force a discharge of fuel under pressure, and to force said pressurized fuel from the chamber to open and pass an injection valve during an injection portion of the pump stroke, means for controlling the length of said infection portion of the pump stroke, said means for controlling including a port-closing edge and a port-opening edge associated with ports opening into the plunger-receiving bore of said bushing, said two edges having different helix angles, not excluding a helix angle of zero for one of them, whereby the interval between port closing and port opening in each pumping stroke is increased as the angular position of the plunger and said edges around the axis of the plunger is adjusted throughout a range of adjustment to increase the injection portion of the pump stroke throughout a corresponding range of engine loads, a groove formed in said plunger and extending along and in association with said port-closing edge at least throughout a portion of the extent of said port-closing edge and at a helix angle, zero or greater, similar to that of said port-closing edge, said groove being thereby associated with a corresponding Dortion of said range of adjustment, said groove, throughout said corresponding portion of said range of adjustment, interacting with the said port that is associated with said port-closing edge to provide, in each of a succession of plunger strokes at each adjustment within said portion of said range of adjustments, initial fuel injection at a feed rate lower than that which would obtain in the absence of said groove while remaining fuel injection, following said initial injection in said each stroke, is not so lowered, said groove being an on-edge groove formed in said port-closing edge itself.

3. A diesel injector for injecting diesel fuel into an engine chamber in a controlled manner, said injector being of the type including a sleeveless pump comprising a two-piece lengthwise-extending pressure-containing plunger-and-bushing subassembly including a pump bushing and a pump plunger sliding in said bushing, a pump chamber at the distal end of said plunger adapted to contain fuel under low pressure prior to the pump stroke of said pump, said pump plunger being reciprocable in the pump bushing for pressurizing fuel in the pump chamber with a pump stroke having predefined rates of displacement along the stroke length to force a discharge of fuel under pressure, and to force said pressurized fuel from the chamber to open and pass an injection valve during an injection portion of the pump stroke, means for controlling the length of said injection portion of the pump stroke, said means for controlling including a port-closing edge and a port-opening edge associated with ports opening into the plunger-receiving bore of said bushing, said two edges having different helix angles, not excluding a helix angle of zero for one of them, whereby the interval between port closing and port opening in each pumping stroke is increased as the angular position of the plunger and said edges around the axis of the plunger is adjusted throughout a range of adjustment to increase the injection portion of the pump stroke throughout a corresponding range of engine loads, a groove formed in said plunger and extending along and in association with said port-closing edge at least throughout a portion of the extent of said port-closing edge and at a helix angle, zero or greater, similar to that of said port-closing edge, said groove being thereby associated with a corresponding portion of said range of adjustment, said groove, throughout said corresponding portion of said range of adjustment, interacting with the said port that is associated with said port-closing edge to provide, in each of a succession of plunger strokes at each adjustment within said portion of said range of adjustments, initial fuel injection at a feed rate lower than that which would obtain in the absence of said groove while remaining fuel injection, following said initial injection in said each stroke, is not so lowered, said groove extending throughout a majority of the length of its said associated port-closing edge.

4. A diesel injector for injecting diesel fuel into an engine chamber in a controlled manner, said iniector being of the type including a sleeveless pump comprising a two-piece lengthwise-extending pressure-containing plunger-and-bushing subassembly including a pump bushing and a pump plunger sliding in said bushing, a pump chamber at the distal end of said plunger adapted to contain fuel under low pressure prior to the pump stroke of said pump, said pump plunger being reciprocable in the pump bushing for pressurizing fuel in the pump chamber with a pump stroke having predefined rates of displacement along the stroke length to force a discharge of fuel under pressure, and to force said pressurized fuel from the chamber to open and pass an injection valve during an injection portion of the pump stroke, means for controlling the lenath of said injection portion of the pump stroke, said means for controlling including a port-closing edge and a port-opening edge associated with ports opening into the plunger-receiving bore of said bushing, said two edges having different helix angles, not excluding a helix angle of zero for one of them, whereby the interval between port closing and port opening in each pumping stroke is increased as the angular position of the plunger and said edges around the axis of the plunger is adjusted throughout a range of adjustment to increase the injection portion of the pump stroke throughout a corresponding range of engine loads, a groove formed in said plunger and extending along and in association with said port-closing edge at least throughout a portion of the extent of said port-closing edge and at a helix angle, zero or greater, similar to that of said port-closing edge, said groove being thereby associated with a corresponding portion of said range of adjustment, said groove, throughout said corresponding portion of said range of adjustment, interacting with the said port that is associated with said port-closing edge to provide, in each of a succession of plunger strokes at each adjustment within said portion of said range of adjustments, initial fuel injection at a feed rate lower than that which would obtain in the absence of said groove while remaining fuel injection, following said initial injection in said each stroke, is not so lowered, said groove being an off-edge groove formed in said plunger adjacent to and spaced from said port-closing edge, the depth of said groove varying along its length, with portions of said groove closer to the portion associated with full load position being deeper than portions of said groove closer to the portion associated with idle position.

5. A device as in claim 4, said variance in depth being a continuous variance at least along a portion of said groove.

6. A diesel injector for injecting diesel fuel into an engine chamber in a controlled manner, said injector being of the type including a sleeveless pump comprising a two-piece lengthwise-extending pressure-containing plunger-and-bushing subassembly including a pump bushing and a pump plunger sliding in said bushing, a pump chamber at the distal end of said plunger adapted to contain fuel under low pressure prior to the pump stroke of said pump, said pump plunger being reciprocable in the pump bushing for pressurizing fuel in the pump chamber with a pump stroke having predefined rates of displacement along the stroke lenath to force a discharge of fuel under pressure, and to force said pressurized fuel from the chamber to open and pass an injection valve during an injection portion of the pump stroke, means for controlling the length of said injection portion of the pump stroke, said means for controlling including a port-closing edge and a port-opening edge associated with ports opening into the plunger-receiving bore of said bushing, said two edges having different helix angles, not excluding a helix angle of zero for one of them, whereby the interval between port closing and port opening in each pumping stroke is increased as the angular position of the plunger and said edges around the axis of the plunger is adjusted throughout a range of adjustment to increase the injection portion of the pump stroke throughout a corresponding range of engine loads, a groove formed in said plunger and extending along and in association with said port-closing edge at least throughout a portion of the extent of said port-closing edge and at a helix angle, zero or greater, similar to that of said port-closing edge, said groove being thereby associated with a corresponding portion of said range of adjustment, said groove, throughout said corresponding portion of said range of adjustment, interacting with the said port that is associated with said port-closing edge to provide, in each of a succession of plunger strokes at each adjustment within said portion of said range of adjustments, initial fuel injection at a feed rate lower than that which would obtain in the absence of said groove while remaining fuel injection, following said initial injection in said each stroke, is not so lowered, said groove being an off-edge groove formed in said plunger adjacent to and spaced from said port-closing edge, the width of said groove varying along the groove's extent.

7. A device as in claim 6, the portions of said groove closer to the portion associated with full load position being wider than the portions of said groove closer to the portion associated with idle position.

8. A device as in claim 6, the portions of said groove closer to the portion associated with full load position being narrower than the portions of said groove closer to the portion associated with idle position.

9. A device as in claim 6, the angle of the edge of said groove that is closest to said port-closing edge being greater than the angle of said port-closing edge.

10. A device as in claim 6, the angle of the edge of said groove that is closest to said port-closing edge being smaller than the angle of said port-closing edge.

11. A device as in claim 1 wherein said spill port that is associated with said port-closing edge is rectangular.

12. A device as in claim 1 wherein said spill port that is associated with said port-closing edge is elliptical.

13. A device as in claim 1, the distance of the edge of said groove that is closest to said port-closing edge from said port-closing edge being substantially equal to the width of said port that is associated with said port-closing edge.

14. A device as in claim 2, the depth of said groove varying along its length, with portions of said groove closer to the port ion associated with full load position being deeper than portions of said groove closer to the portion associated with idle position.

15. A device as in claim 14, said variance in depth being a continuous variance at least along a portion of said groove.

16. A device as in claim 14, the width of said groove varying along the groove's extent.

17. A device as in claim 16, the portions of said groove closer to the portion associated with full load position being wider than the portions of said groove closer to the portion associated with idle position.

18. A device as in claim 16, the portions of said groove closer to the portion associated with full load position being narrower than the portions of said groove closer to the portion associated with idle position.

19. A device as in claim 2 wherein said port that is associated with said port-closing edge is rectangular.

20. A device as in claim 2 wherein said port that is associated with said port-closing edge is elliptical.

21. In a diesel injector for injecting diesel fuel into an engine chamber in a controlled manner, said injector being of the type including a sleeveless pump comprising a two-piece lengthwise-extending pressure-containing plunger-and-bushing subassembly including a pump bushing and a pump plunger sliding in said bushing, a pump chamber at the distal end of said plunger adapted to contain fuel under low pressure prior to the pump stroke of said pump, said pump plunger being reciprocable in the pump bushing for pressurizing fuel in the pump chamber with a pump stroke having predefined rates of displacement along the stroke length to force a discharge of fuel under pressure, and to force said pressurized fuel from the chamber to open and pass an injection valve during an injection portion of the pump stroke, means for controlling the length of said injection portion of the pump stroke, said means for controlling including a port-closing edge and a port-opening edge associated with ports opening into the plunger-receiving bore of said bushing, said two edges having different helix angles, not excluding a helix angle of zero for one of them, whereby the interval between port closing and port opening in each pumping stroke is increased as the angular position of the plunger and said edges around the axis of the plunger is adjusted throughout a range of adjustment to increase the injection portion of the pump stroke throughout a corresponding range of engine loads, a groove formed in said plunger, said groove being adjacent to and generally parallel to but spaced from said port-closing edge along at least a portion of the latter's length, and ducting in or on said plunger joining said groove in fluid communication with said pump chamber, said groove extending along at least a majority of the portion of said associated port-closing edge that is associated with the high end of the range of injection portions of the pump stroke.

22. A device as in claim 1 wherein said port that is associated with said port-closing edge is round.

23. A device as in claim 2 wherein said port that is associated with said port-closing edge is round.

* * * * *

UNITED STATES PATENT AND TRADEMARK OFFICE

CERTIFICATE OF CORRECTION

PATENT NO. : 6,009,850

DATED : January 4, 2000

INVENTOR(S) : Frank DeLuca

It is certified that error appears in the above-indentified patent and that said Letters Patent is hereby corrected as shown below:

Column 6, line 63 delete "isrplunger;" and insert therefore --plunger;--.

Column 9, line 55 after "G" delete --ir--.

Column 12, line 41 delete "rrange." and insert therefore --range.--.

Col. 15, Claim 2, line 55 delete "infecting" and insert therefore --injecting--.

Col. 16 Claim 2, line 4 delete "infection" and insert therefore --injection--.

Col. 16, Claim 2, line 22 delete "Dortion" and insert therefore --portion--.

Col. 17, Claim 4, line 14 delete "iniector" and insert therefore --injector--.

Col. 18, Claim 6, line 11 delete "lenath" and insert therefore --length--.

Col. 19 Claim 14, line 3 delete "port ion" and insert therefore --portion--.

Signed and Sealed this

Fifteenth Day of August, 2000

*Attest:*

Q. TODD DICKINSON

*Attesting Officer*

*Director of Patents and Trademarks*